US006854730B2

(12) United States Patent
Braun

(10) Patent No.: US 6,854,730 B2
(45) Date of Patent: Feb. 15, 2005

(54) SLOTTED GAME BOARD AND GAMING TABLE

(76) Inventor: Louis F. Braun, 4161 Penrose Pl., Rapid City, SD (US) 57702

( * ) Notice: Subject to any disclaimer, the term of this patent is extended or adjusted under 35 U.S.C. 154(b) by 0 days.

(21) Appl. No.: 10/179,626

(22) Filed: Jun. 25, 2002

(65) Prior Publication Data

US 2003/0234494 A1 Dec. 25, 2003

(51) Int. Cl.[7] ..... A63F 1/10
(52) U.S. Cl. ..... 273/150; 273/148 A
(58) Field of Search ..... 273/150, 148 A, 273/148 R, 309; D21/392–396

(56) References Cited

U.S. PATENT DOCUMENTS

| | | | | | |
|---|---|---|---|---|---|
| 2,394,866 | A | | 2/1946 | McClune | |
| 2,620,928 | A | | 12/1952 | Brooks | |
| 2,742,292 | A | | 4/1956 | McDonough | |
| 3,635,478 | A | * | 1/1972 | Hatley | 273/148 A |
| 4,266,771 | A | * | 5/1981 | Carbone et al. | 273/150 |
| 4,291,882 | A | * | 9/1981 | Del Monte | 273/148 A |
| D262,727 | S | | 1/1982 | Snyder | |
| D264,358 | S | * | 5/1982 | Welteroth | D21/54 |
| D271,895 | S | | 12/1983 | Runions | |
| D273,961 | S | | 5/1984 | Bassey | |
| 4,453,714 | A | | 6/1984 | Houser | |
| 4,684,132 | A | * | 8/1987 | Wolford | 273/150 |
| 5,215,198 | A | | 6/1993 | Sutton | |
| D353,412 | S | | 12/1994 | Bull et al. | |
| D397,735 | S | * | 9/1998 | Spranger | D21/54 |
| 6,092,676 | A | | 7/2000 | Graham | |
| D439,622 | S | * | 3/2001 | Golad et al. | D21/392 |
| 6,405,878 | B1 | | 6/2002 | Graham | |

* cited by examiner

*Primary Examiner*—Benjamin Layno
(74) *Attorney, Agent, or Firm*—Karl G. Hanson

(57) ABSTRACT

A game board for supporting cards and gaming pieces such as dominos. The game board includes a board that has first and second major surfaces and first and second sets of slots. The first set of slots is sized and configured for supporting gaming pieces like dominos and is disposed within the first major surface of the game board. The second set of slots is sized and configured for supporting playing cards. The second set of slots is disposed on the first major surface of the game board but within the first set of slots to form a set of compound slots. The game board could be used on a gaming table that has multiple recessed areas for receiving and supporting each game board flush with the top surface of the table.

20 Claims, 5 Drawing Sheets

SLOTTED GAME BOARD AND GAMING TABLE

The present invention pertains to a game board that is capable of supporting both playing cards and gaming pieces such as dominos from the same side of the board. The invention also pertains to a gaming table that is capable of supporting playing cards and gaming pieces such as dominos.

BACKGROUND

Card players commonly use their hands to support their cards during play. Because some card games involve the contemporaneous need to view up to 17–20 cards at a time, it can be cumbersome to hold the cards in the hands without letting your opponent see some of the cards. When a player needs to view so many cards at once, they are commonly arrange in linear fashion, with each successive card being offset behind an adjacent card. The cards are also held close to the chest so that opposing players cannot see them. Strategic planning and thinking, however, is less than ideal for this manual arrangement of cards, and the hands can easily cramp and can become painful from fatigue, particularly when the game lasts a long time.

Another game that requires a need to view many game pieces at once is dominos. Like a card game, dominos also involves strategic planning and thinking to prevail over your opponent. Unlike cards, however, the dominos are often supported on the table in front of the player rather than being held in the hands. Quite often the organization of dominos is difficult, particularly when a player has to view many pieces at once. Domino pieces also are susceptible to becoming scattered during play from accidental movements of the table and from the players' hands and arms.

To overcome the deficiencies of using the hands or table surface to support cards or dominos, innovators have developed card boards and domino boards to support these gaming items in a stable manner for contemporaneous viewing. The card boards typically have included a set of thin slots on one side of the board. The cards are placed in the slots and rest in an inclined position facing the player. Card boards have been on the market for at least about 10 years.

The domino game boards also have included a plurality of slots, but the slots are wider to accommodate the greater thickness of dominos. Although known game boards have been beneficial in that they provide players with an alternative method of supporting gaming pieces, they do present drawbacks. Firstly, the same game boards cannot be used for playing both dominos and cards. Players must keep and locate separate game boards for each game. Further, if card slots are disposed on one side of the game board and domino slots are located on the other side, so that the same board can be used for either game, the combination card/domino board is nonetheless problematic to players because each side of the board contains grooves, which precludes the use of a stabilizing (i.e., anti-marring, or friction producing) surface on either side of the board. In addition, the card slots in known gaming boards are very thin, and therefore require precision when placing the cards in the slot. If a player is rushed or is not careful when inserting the card into the slot, the player risks missing the slot and having the card fall to the surface of the playing table where it can be readily seen by opposing players. Location of the card slot is particularly troublesome to the elderly whose eyesight and manual dexterity may have deteriorated. Thus, although known game boards have been able to support either playing cards or dominos, they have nonetheless presented drawbacks that can disrupt the enjoyment and cadence of the game.

SUMMARY OF THE INVENTION

The present invention is directed to a new game board that overcomes the drawbacks just described. The game board of the invention, in brief summary, may suitably comprise or consist essentially of a board that has first and second major surfaces and that has first and second sets of slots that are sized and configured for supporting dominos and playing cards, respectively. The first set of slots is disposed within the first major surface of the game board, and the second set of slots is disposed on the first major surface of the game board but within the first set of slots. The game board of the present invention therefore has a compound slot that will accommodate both cards and dominos.

The inventors discovered that the use of a compound slot on the same side of a game board can allow the card slot to be more easily found by the player. Because the card slot is disposed within the wider domino slot, the player only needs to locate the domino slot to have the card ultimately directed into the card slot. The compound slot also has the advantage of improving the spacing between rows of slots and keeping the size of the board within reasonable limits while still allowing a large number of cards or dominos to be supported during play. The inventors further discovered that if the card and domino slots were both incorporated into one side of a game board, the other side could be grooveless. A non-grooved bottom surface can allow a high friction sheet to be adhered to it, or it can allow rubber or plastic feet to be secured at the corners to stabilize the board and to reduce vibration, marring, and slippage. The use of a stabilizing sheet or high friction feet, however, is not suitable for boards that have slots on both sides because the sheet and feet would project upwardly from the surface of the board that is also used to support the playing cards or dominos.

The dimensions of the compound slot may be altered to allow the game board to be used for supporting gaming pieces other than dominos. For example, the larger slot could be configured to support Scrabble® or Rummikub® gaming pieces.

The inventive game board alternatively can be configured to fit into a recess in a table surface, flush with the topside of the table to eliminate the need for a high friction bottom surface. When the table is not used for playing cards, dominos, or other gaming pieces, the non-grooved side of the game board can be in the "up position" simply by inverting the game board, allowing the gaming table to serve basically any other table purpose. Alternatively, the game board can be permanently bonded into or integrally disposed within the table surface, with the slotted side flush with the table top surface.

In another aspect, the present invention also provides a gaming table that comprises a table top and a plurality of game boards. The table top has a top surface and a plurality of recesses that are disposed in the top surface. The game gaming boards are each sized and configured to be removably placed in the recesses, or they may be permanently bonded into the table with the slotted side flush with the top surface. The game boards have first and second major surfaces with a plurality of slots disposed in at least one of the fir t or second major surfaces. The slots are sized and configured for supporting playing cards or gaming pieces. The game boards are configured to have a thickness that allows at least one of the first or second major surfaces to reside flush with the top surface of the table when the game board is disposed in a recess or is mounted within the top surface. In this instance, card slots and gaming piece slots could beneficially be disposed on each of the opposing major surfaces of the game board.

The recess in the top surface of the gaming table can preclude the game board from moving inadvertently across the table's surface. There is no need for a stabilizing surface on either side of the game board. Thus, one side could be used for supporting dominos and the other side could be used for supporting playing cards. The recess also allows the table to be used for purposes other than playing cards, dominos, Rummikub® or Scrabble® because each game board resides flush with the top surface of the table. In a preferred embodiment, the card and/or gaming piece slots are all disposed on one surface of the game board so that when inverted, none of the slots may be seen from the top surface of the table. The game boards therefore could be inverted when the table is used for other purposes.

These and other aspects and benefits of the invention are more fully shown and described in the drawings and detailed description of this invention, where like reference numerals are used to represent similar parts. It is to be understood, however, that the drawings and description are for illustration purposes only and should not be read in a manner that would unduly limit the scope of this invention.

DETAILED DESCRIPTION OF PREFERRED EMBODIMENTS

In the practice of the present invention, a game board is provided, which has a compound slot for supporting both playing cards and gaming pieces such as dominos. The playing cards and gaming pieces may be supported in the game board in a manner that prevents others from viewing that particular player's cards or gaming pieces. As the term is used in this document, "gaming pieces" means an item used in a game, which has indicia on at least one surface for conveying information to one or more of the players, and which has a generally uniform size and has a thickness greater than a playing card. Examples of gaming pieces include dominos, Scrabble® pieces, and Rummikub® pieces.

Figure 1A:
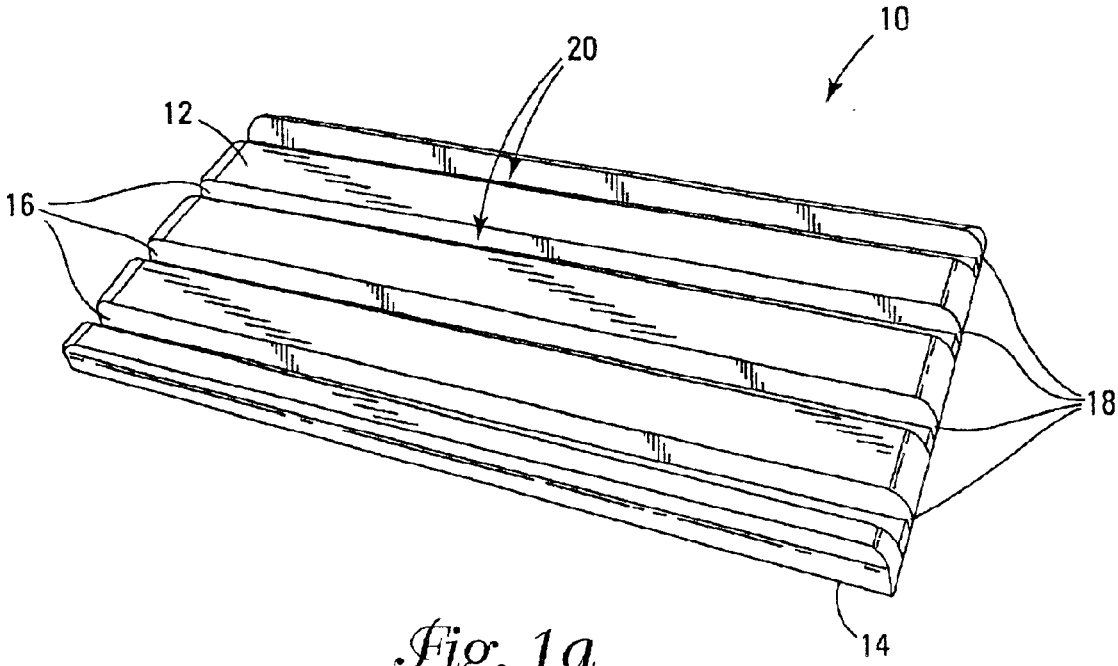
FIGS. 1*a* and 1*b* are perspective views of a game board 10 in accordance with the present invention.
Figure 1B:
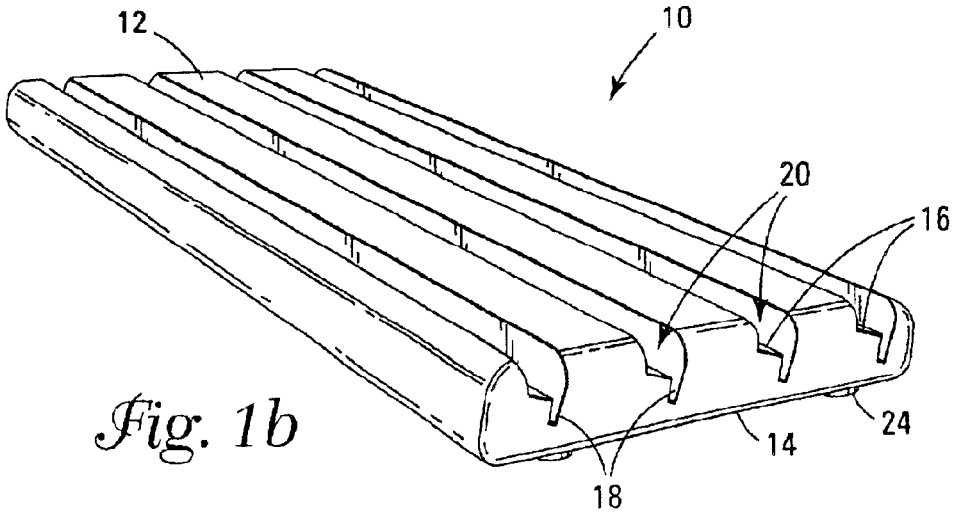

FIGS. 1*a* and 1*b* show a game board 10 that has first and second major surfaces 12 and 14, respectively. A first set of slots 16, sized and configured for supporting dominos, is disposed within the first major surface 12 of the gaming board 10. A second set of slots 18 is also disposed within the first major surface 12 of the gaming board, but within the first set of slots 16. Together, slots 16 and 18 represent a compound slot 20.

Figure 2:
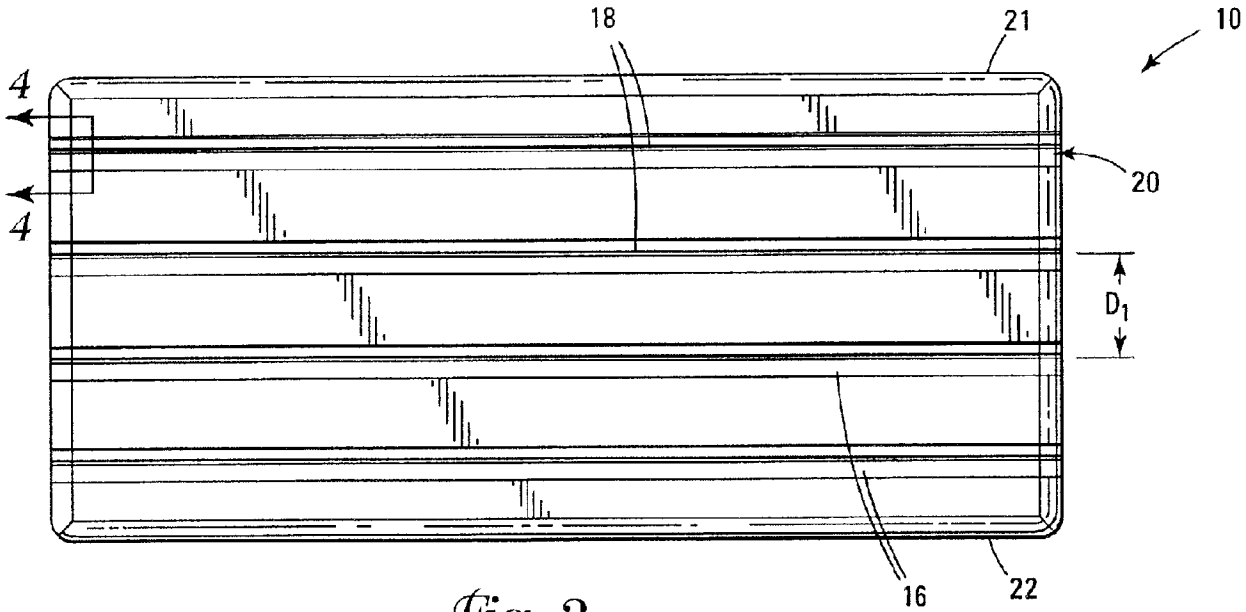
FIG. 2 is a top view of the game board 10 in accordance with the present invention.

FIG. 2 illustrates the spacing between the slots at a distance $D_1$. The distance $D_1$ preferably is small enough to allow multiple slots to be incorporated into a reasonably sized game board. $D_1$ also should be large enough to allow all the cards or gaming pieces in each row to be easily viewed by the respective player. $D_1$ can be increased slightly for each successive compound slot, as you move towards the rear edge 21 of the board 10. The increase in spacing between the slots from the front edge 22 to the trailing edge 21 can provide the same viewing advantages for gaming pieces or cards, even as the viewing angle and distance change slightly as compound slots become further away from the eye of the player. In a preferred embodiment, $D_1$ is about 0.8 to 1.5 inches in length, and more preferably is about 1.1 to 1.3 inches in length. If progressive spacing is used, the distance between the slots 20, located closest to the front edge 22, is about 15 to 25% less than the spacing between the two slots located closest to the trailing edge 21.

Figure 3:
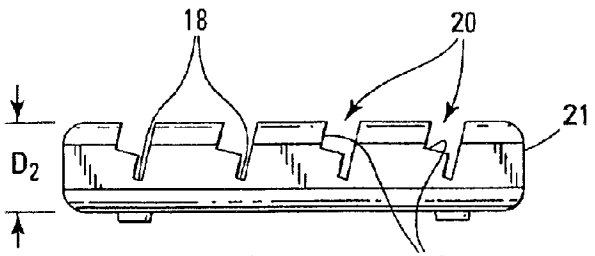
FIG. 3 is a right side view of the game board 10 of the present invention.

FIG. 3 shows the thickness of the game board and shows how the slots 16, 18, 20 are angled from the vertical towards the rear edge 21. $D_2$ represents the overall thickness of the game board. If $D_2$ is too small, the game board may lack sufficient mechanical strength and could possibly be broken. If $D_2$ is too large, however, the game board can become costly, heavy, and unwieldy in use and may stand too high off the table or playing surface. It has been found that the game board can best accomplish its supporting tasks and be sufficiently durable if it is about 0.6 to 1.0 inches thick, preferably 0.7 to 0.8 inches thick.

Figure 4:
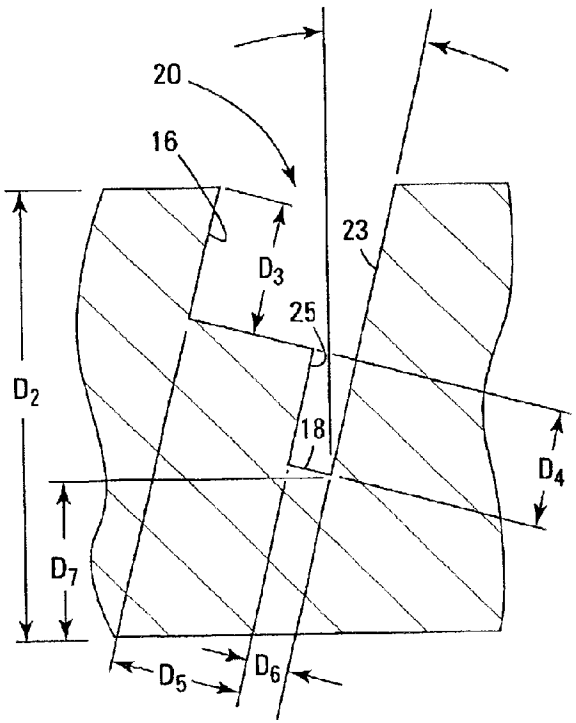
FIG. 4 is an enlarged sectional view of a combined domino/card slot 20 taken along lines 4—4 of FIG. 2.

FIG. 4 is a close up view of one of the compound slots with dimensions and angles shown in detail. In the compound slot 20, dimensions $D_3$ and $D_4$ which represent the depth of the gaming piece and card slots, respectively, control the depth of retention of gaming pieces and cards. $D_3$ should be deep enough to retain the gaming pieces in slot 16 and to keep them from tipping backwards, and yet be shallow enough to allow viewing of all the indicia on the gaming piece. When the gaming piece is a domino, $D_3$, preferably is about 0.15 to 0.3 inches. Slot 16 also should have a shoulder or ledge with a width $D_5$ that is great enough when combined with $D_6$ to allow for an easy insertion of the dominos but be narrow enough to hold the pieces in a stable fashion. The width of the domino slot 16, which is the sum of $D_5$ and $D_6$, preferably is about 0.38 to 0.53 inches, more preferably is about 0.40 to 0.43 inches. The sum of $D_5$ and $D_6$ typically is sized about 1/32 inch larger than the thickness of the domino or other gaming piece to allow for easy insertion of the gaming piece while supporting it in a secure fashion. The portion of the card slot 18 that has mutually opposed faces that contact opposing surfaces of the cards, $D_4$, preferably has a depth of about 0.2 to 0.3 inches, and more preferably between 0.23 and 0.27 inches. Angle $\alpha$ is the angle that extends between a plane that projects normally from the horizontal along the length of the slot and a plane that projects parallel to the sidewall of either the domino or card slot. Angle $\alpha$ is particularly important for operations using playing cards. If angle $\alpha$ is too close to the vertical, the cards may not naturally rest against the rear of the compound slot (that is, the surface 23 that resides in the slot away from the user when the board is in use). In this instance, the cards may pitch forward and make viewing difficult. On the other hand, if angle $\alpha$ is too great, the cards may be tilted too close to the horizontal, allowing them to be viewed by other players, thus breaching the security feature of the invention. Preferably, both the domino and card slots 16 and 18, respectively, are offset from the vertical at the same angel $\alpha$. Angle $\alpha$ could vary, however, for each slot 16 and 18 if so desired. Preferably angle $\alpha$ is about 5 to 20 degrees, more preferably about 10 to 16 degrees.

The dimensions of the slots 16 and 18 also have an important bearing o the operation of the game board. Playing cards rest in the smaller slot having a width $D_6$. The side 25 of the card slot 18 that faces the user has a depth $D_4$, and the side 23 is located towards the rear edge 21 has a depth slightly larger than $D_3$ plus $D_4$, and it forms a backrest for the cards. If $D_6$ is too wide, the cards can rock back and forth, and if $D_6$ is too narrow it becomes difficult to easily place cards in the slot. $D_6$ preferably is between 0.045 and 0.125 inches, more preferably between 0.070 and 0.10 inches. It has been discovered that control over $D_6$, $D_4$, and angle $\alpha$ can have great benefits in countering the force of the wind when playing cards outside or from fans if playing cards indoors. The ratio of $D_4$:$D_6$ is 1.6 or greater and preferably is 2 or greater, and still more preferably is 2.86 or greater In addition, angle $\alpha$ can be increased slightly between successive rows of compound slots from the back edge 21 towards the front edge 22 (FIG. 2) to keep the angle between the eye of the player and the card or game piece constant. Proper selection of these parameters results in minimal movement under windy conditions and no flopping of cards to nonviewable positions. Even though the dimensions $D_3$, $D_4$, $D_5$, and $D_6$ and angle $\alpha$ are important, there are variations in these distances that may nonetheless be successful.

Figure 5:
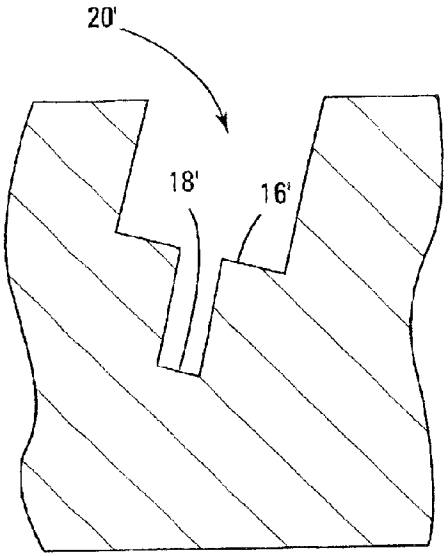
FIG. 5 is an alternative embodiment of a combined domino/card slot 20' in accordance with the present invention.

FIG. 5 shows an alternative embodiment of a compound slot 20'. In this embodiment, the card slot 18' is also disposed within the gaming piece slot 16'. The term "within" is used herein to mean that the card must first pass through the gaming piece slot before reaching the recessed supporting structure of the card slot. In this embodiment, the card slot 18' is disposed centrally at the bottom of the domino slot 16'. In yet another version of this embodiment, the gaming piece slot 16' could be tapered at the bottom so that a card can be more easily directed from the gaming piece slot into the card slot 18'. A tapered slot can act as a funnel, leading the card from the gaming piece slot 16' to the card slot 18'. Preferably the edges at the top of the card slot 18' are slightly rounded to avoid fraying card edges. A rounded corner can provide a smooth transition from the domino slot 16' to card slot 18'.

Figure 6:
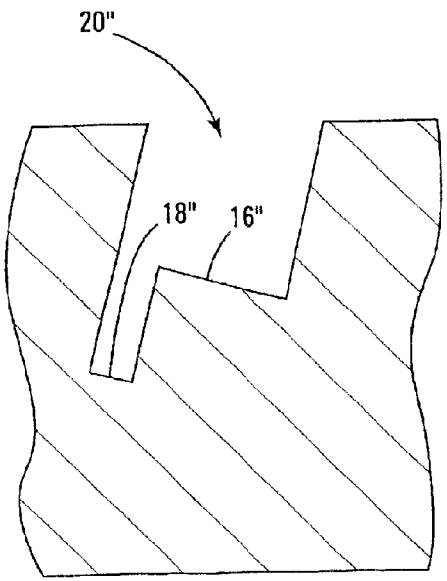
FIG. 6 is another alternative embodiment of a combined domino/card slot 20" in accordance with the present invention.

FIG. 6 shows yet another embodiment of a compound slot 20", wherein the card slot 18" is disposed towards the front of the gaming board. Like the embodiments described above, the gaming piece slot 16" may also be tapered or rounded at the corners to allow the card to more easily find the card slot 18". This embodiment has the advantage in that the cards are moved closer to the player when the game board is in use. This can make the cards more easily visible to that particular player while at the same time reducing the opportunity for other players to see the cards that are supported by the game board. Playing cards are inserted easily by placing them into the large opening at the top of the gaming piece slot 16" and then bringing them forward (towards edge 22) until the edge of the card slot is felt, making it possible to simply lower the card into the slot fully. After one or two tries, this sequence of motions may become second nature, automatic, or habitual.

Figure 7:
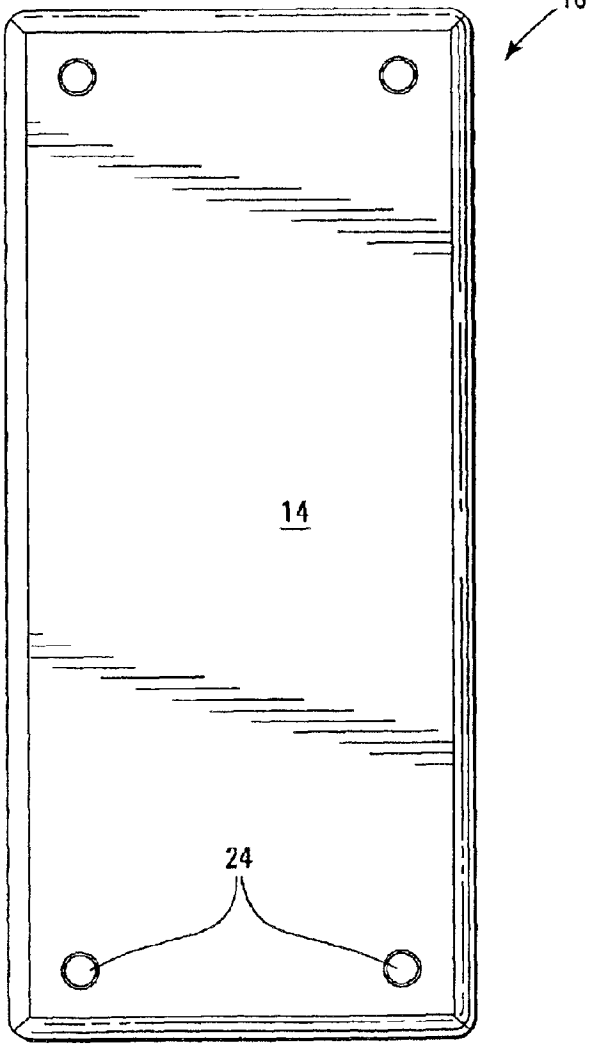
FIG. 7 is a bottom view of a game board 10 in accordance with the present invention.

FIG. 7 shows the rear supporting surface of a game board 10. The second major surface 14 of the game board can have a plurality of feet 24 disposed towards the corners of the game board for supporting it on a flat surface. The feet 24 preferably are made from a resilient material that would provide a high-friction, non marring interface on flat surfaces such as wood tables. The feet thus would prevent the game board from sliding across the supporting surface or from vibrating on or scratching the supporting surface during use. The feet 24 are preferably positioned on the surface of the game board towards the corners such that the feet do not fall within the compound slot of another game board when the boards are stacked. This allows the boards to be evenly stacked for storage. A particular advantage of the present invention is that the use of the compound slots 20, 20', 20" on the first major surface 12 of the gaming board allows a second major surface 14 to have high friction vibrational dampening features so that it can be better supported on a surface such as a table. In lieu of feet 24, the game board could have an elastic or felt-type sheet disposed over the second major surface for anti-friction, anti-marring, or stabilization purposes.

Figure 8:
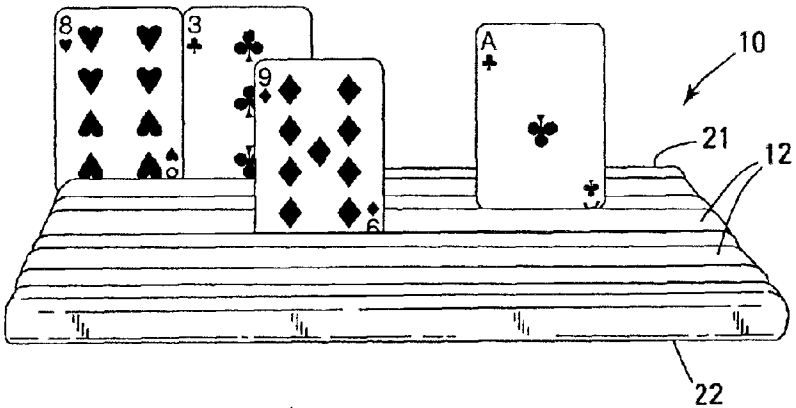
FIG. 8 is a front perspective view of a game board 10 that has cards supported in the slots 18 in accordance with the present invention.
Figure 9:
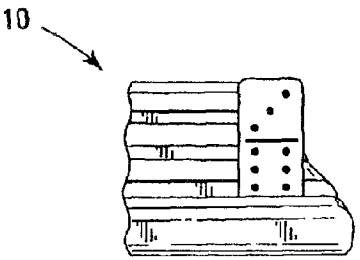
FIG. 9 is a front broken perspective view of a game board 10 that has a domino supported in it in accordance with the present invention.

FIGS. 8 and 9 show how cards and dominos can be supported on the inventive gaming board. As shown, the cards can be arranged in a variety of orders, for example, according to suit or rank. For example, all "hearts" could be deployed in one slot, whereas all "clubs" could be deployed in another slot. Alternatively, face cards could be arranged in one or more slots, and number cards could be arranged in other slots.

In a game of dominos, the gaming pieces can be arranged such that ends that have a similar number of dots shown on them can be placed next to each other so that the user can strategically plan the deployment of each domino in successive order. To this end, the dominos could also be laid on edge rather than in the upright position shown in FIG. 9.

Figure 10:
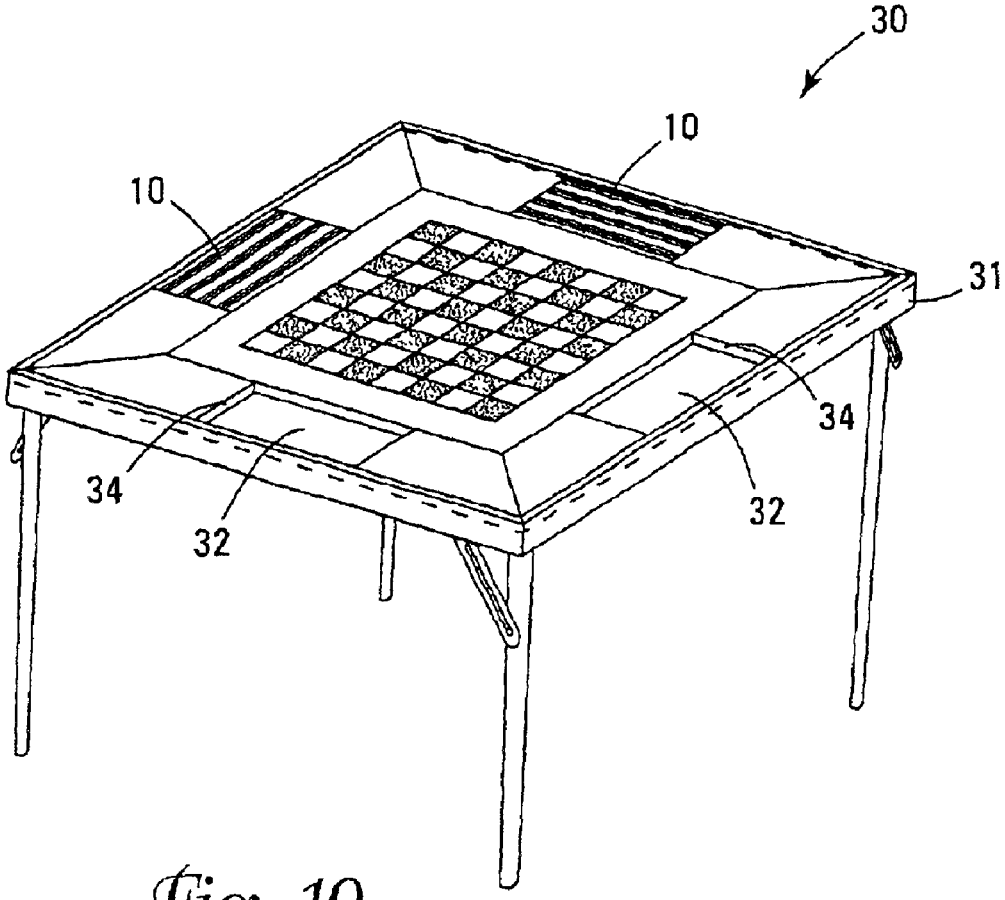
FIG. 10 is a perspective view of a gaming table 30 in accordance with the present invention where multiple gaming boards 10 are shown disposed in recesses 32.

FIG. 10 shows a plurality of gaming boards disposed within a gaming table 30. The gaming table 30 includes a table top 31 that has a top surface and a bottom surface. A plurality of legs extend from the bottom surface of the table top to support it in spaced relation from a floor onto which the gaming table may reside. Gaming table 30 also contains a plurality of recessed regions 32, which have a depth that equals the thickness of the game board 10. The recessed regions 32 allow the game boards to reside flush with the tabletop surface. When using game boards that have the supporting slots disposed only on one surface, the gaming boards can be inverted when persons are not using the table for playing cards or dominos. Under these instances, the table may serve another function. Alternatively, the gaming board could be inverted if there is not a person sitting at that location on the table who is playing cards, dominos, Scrabble™, etc. In another situation, the gaming table of the present invention includes a plurality of gaming boards that have card or gaming piece slots disposed on one or both sides of each game board. When used in conjunction with the gaming table 30, the gaming boards would not need feet 24 (FIG. 7) or other frictional/dampening member on the bottom or second major surface of the gaming board. Because the table includes a plurality of recessed regions, each gaming board is disposed in the table without risk of lateral movement. The side walls 34 of each recessed region prevent the game board from making lateral movements on the table. In another embodiment, the game boards may be "integral" with the table. That is, they may be formed as a continuous one-piece part of the table top or permanently secured to it, for example by gluing the bottom surface 14 (FIG. 7) to the opposing face in the recess.

Below in Table 1 are dimensions in inches for the particular distances described in reference to FIGS. 2 and 4 for a game board that is adapted to accommodate playing cards and dominos:

TABLE 1

Workable Dimensions in Inches and Angle α in Degrees

| $D_1$ | $D_2$ | $D_3$ | $D_4$ | $D_5$ | $D_5 + D_6$ | $D_6$ | Angle α |
|---|---|---|---|---|---|---|---|
| 1.15 | 0.75 | 0.170 | 0.25 | 0.315 | 0.41 | 0.093 | 14 |

The game board of the invention is beneficial because it can greatly improve player ergonomics and can alleviate hand fatigue and cramping. It also may improve a player's skill level by allowing the player to form strategic patterns of the gaming pieces. Additionally, the game board allows a person's hands to be free for other uses such as gestures, or eating and drinking while the game is in play. The game boards can be constructed so that gaming pieces cannot be seen by opposing players but yet provide improved visual contact by the player who "owns" that particular game board. Further, each game board can be incorporated into a recess in a table surface for game playing. Inverting the game board creates a smooth table surface for normal use. The game board can be made of solid materials that are stable at room temperatures. Examples of useful materials include wood, metal, and plastic, ceramics, and compressed paper fibers.

There can be two game boards opposite each other, or the table can have three, four, five, or six game boards to accommodate additional players. The table would preferably take on a different configuration when viewed from the top, depending on the number of desired players. For example, a table that is fashioned to accommodate three players would be triangular, while a table that is fashioned to accommodate four, five, or six players could be square, pentagon, or hexagon, respectively, with each side having a game board. If more than four sides are used, there is a progressively reduced degree of security between players because it becomes easier for players to see the adjoining player's game pieces.

The table top 31 also can have by virtue of side trim boards that are wider than the top thickness a slightly recessed bottom surface so that it securely resides on top of a standard card table. This eliminates the need for making legs to be used only with the gaming table 30.

The following Example has been selected merely to further illustrate features, advantages, and other details of the invention. It is to be expressly understood, however, that while the Example serves this purpose, the particular ingredients and amounts used, as well as other conditions and details, are not to be construed in a manner that would unduly limit the scope of this invention.

EXAMPLE

The present invention has been actually reduced to practice using wood. The compound slot of the invention was made by combining a standard saw blade in series with a dado saw blade. $D_5$ plus $D_6$ was equal to the total cut width for the combination of the standard blade and the dado blade. $D_6$ was controlled by the cutting kerf of the standard blade. $D_4$ was controlled by the difference in radius of the standard blade and the dado blade. $D_3$ was controlled by the depth setting of the combined blades. Angle α was controlled by the angle setting of the blades. $D_5$ plus $D_6$ was adjusted by using shims between the edge cutting blades and the chipper blades of the dado blade or by adjusting the wobble angle of the dado blade.

A rotary cutting tool set for cutting compound slots was made by stacking, in the order shown below, standard tools and hand made spacers on the arbor of a Delta 10 inch Contractors Table Saw with Unifence model number 34-445:

1. Vermont American #26741 6 inch diameter Stack Dado set components,
   a) ⅛" Main cutter blade
   b) ⅛" inside cutter blade
   c) Cardboard washer 0.048 inches thick
   d) White washer 0.005 inches thick
   e) 1/16 inch inside cutter blade, and
2. Black and Decker 6½ inch saw blade #73-590 (tooth is 0.087 inches wide, kerf width of 0.093 inches)

This assembly makes a cut width that is less than the sum of the thickness above because some of the components overlap. The width of cut ($D_5$ plus $D_6$, FIG. 4) was about 0.493 inches, which is larger than desired due to an error in estimating the space thickness. For thicker game pieces, however, the 0.493 inch width ($D_5$ plus $D_6$) might be ideal.

A ⅛ inch roundover router bit from Companion router bit set #925525 was installed on a shaper table, and the bit height was set to for a flush roundover cut of edges as shown in FIG. 3 and as described below.

A 1×6 inch (nominal dimensions) oak board was cut to 11½ inch lengths. Thickness and width were 0.735 and 5 23/32 inches, respectively. These pieces were then given roundover edge treatment on all 11½ inch and 5 23/32 inch edges. The 5 23/32 inch edges were cut first (feed rate was about 2 inches per second) to avoid end grain chip-out. The 11½ inch edges were cut next (feed rate was about 4 inches per second). The 0.735 inch edges were rounded with a 180 grit sanding block to match the other edges.

The Dado and saw blade assembly were mounted on the table saw arbor as described above was set to cut angle α. The saw rpm was 3450, and scrap wood was cut and the cutting depth was adjusted until depth of saw cut ($D_2$ minus $D_7$) was 0.535 inches.

A set of three pusher/spacers was made to allow the fence to be set just once. The spacers were in multiples of 1 3/16 inches width, making the first 1 3/16 inches, the second 2⅜ inches and third 3 9/16 inches. Spacers were 11½ inches long and ¾ inches thick to match the playing boards. Each spacer had a small board glued at one end to allow a push stick to push the playing board and the fence spacer through together safely.

The fence is set at 4 3/16 inches, and the first slot is made with no spacer, the second with the 1 3/16 inch spacer, the third with the 2⅜ inch spacer and the fourth with the 3 9/16 inch spacer. The wood was fed in the same, front to back board orientation so the slots were cut in the same angular orientation. The feed rate was about 6 inches per second.

Oak was used in this example, but any wood could be used such as alder, clear pine, mahogany, birch, cedar, maple, etc. It is important to select wood free of loose knots because the knots may break out when cutting the compound slots.

The 5 23/32 inch width would likely change to 5½ inches to allow standard lumber width to be used. If so, slot-to-slot spacing would be adjusted accordingly.

To apply finish, the boards were sanded with fine 320-grit sandpaper and a coat of polyurethane (oil base) finish was applied.

After the finish dried, four standard 9½ millimeter (mm) self adhesive cupboard door bumpers with flat outer surface instead of convex were applied at the corners of each of the boards on the side opposite the slotted sides. These were found to add stability on the playing table surface.

One of the boards was accidentally dropped, and as a result, it broke. The particular wood stock used in this example was somewhat thinner than the standard 0.75 inch thickness, and this contributed to the breakage. It was also noted that the depth of the compound slots could have been reduced slightly since $D_3$ (shown below) was more than adequate for retaining dominos. $D_2$ (also shown below) could be reduced significantly by use of a 6.4 inch saw blade. The combination of these adjustments would greatly strengthen the boards in the case of accidental dropage.

The dimensions of finished boards (see FIG. 4) are shown below in Table 2. The dimensions are given in inches and the Angle $\alpha$ is provided in degrees.

TABLE 2

Dimensional Results for Example 1

| $D_1$ | $D_2$ | $D_3$ | $D_4$ | $D_5$ | $D_6$ | $D_5 + D_6$ | $D_7$ | Angle $\alpha$ |
|---|---|---|---|---|---|---|---|---|
| 1.187 | 0.735 | 0.21 | 0.25 | 0.40 | 0.093 | 0.493 | 0.20 | 14° |

Additional examples could be added to teach effects of alternative dimensions and angles under varied uses such as playing outdoors or under fans where windy conditions may exist and to provide a basis for the preferred ranges of properties for the present invention.

This invention may take on various modifications and alterations without departing from its spirit and scope. Accordingly, it is to be understood that this invention is not to be limited to the above-described but that it is to be controlled by the limitations set forth in the following claims and any equivalents thereof. It also is to be understood that this invention may be suitably practiced in the absence of any element not specifically disclosed herein.

What is claimed is:

1. A game board for supporting cards and gaming pieces, which game board comprises:

a) a board that has first and second major surfaces;

b) a first set of slots sized and configured for supporting gaming pieces, the first set of slots being disposed within the first major surface of the game board; and c) a second set of slots sized and configured for supporting playing cards, the second set of slots also being disposed on the first major surface of the game board but within the first set of slots to form a plurality of compound slots, wherein the ratio of the depth $D_4$ to the width $D_6$ of the second set of slots is 1.6 or greater.

2. The game board of claim 1, wherein the first set of slots are sized and configured for supporting dominos.

3. The game board of claim 2, wherein a depth $D_3$ of the first set of slots is about 0.15 to 0.3 inches.

4. The game board of claim 3, wherein a width $D_5$ plus $D_6$ of the first set of slots is about 0.38 to 0.53 inches.

5. The game board of claim 4, wherein the width of the first set of slots is about 0.4 to 0.43 inches.

6. The game board of claim 1, wherein the compound slots are offset at an angle $\alpha$ from a plane that bisects the board in a vertical orientation.

7. The game board of claim 6, wherein angle $\alpha$ is about 5 to 20 degrees.

8. The game board of claim 7, wherein angle $\alpha$ is about 1 to 16 degrees.

9. The game board of claim 7, wherein the angle $\alpha$ increases slightly between successive rows of compound slots from the rear edge to the front edge.

10. The game board of claim 1, wherein the compound slots are spaced at a distance of about 1.1 to 1.3 inches.

11. The game board of claim 1, wherein the spacing between the compound slots located closest to the front edge is about 15 to 25 percent less than the space between the compound slots located closest to the rear edge, and wherein the game board has a thickness of 0.6 to 1 inch.

12. The game board of claim 1, wherein a width of the first set of slots is sized to be about 1/32 of an inch larger than the thickness of the gaming piece that would be disposed in the first set of slots during play.

13. The game board of claim 1, wherein the slots in the second set have a depth $D_4$ of about 0.2 to 0.3 inches.

14. The game board of claim 13, wherein the slots in the second set have a depth $D_4$ of about 0.23 to 0.27 inches.

15. The game board of claim 1, wherein the first set of slots is tapered at the bottom so that a playing card can be more easily directed from a slot in the first set into a slot in the second set.

16. The game board of claim 1, wherein the second set of slots is disposed closer to the rear of the compound slot.

17. The game board of claim 1, wherein the game board includes a non-marring means that is disposed on a second major surface of the game board.

18. The game board of claim 1, wherein the ratio of the depth to the width of the second set of slots is 2 or greater.

19. The game board of claim 1, wherein the ratio of the depth to the width of the second set of slots is 2.86 or greater.

20. A game board for supporting cards and gaming pieces, which game board comprises:

a) a board that has first and second major surfaces;

b) a first set of slots sized and configured for supporting gaming pieces, the first set of slots being disposed within the first major surface of the game board; and c) a second set of slots sized and configured for supporting playing cards, the second set of slots also being disposed on the first major surface of the game board but within the first set of slots to form a plurality of compound slots, wherein the ratio of the depth to the width of the second set of slots is 1.6 or greater, wherein the compound slots are offset at an angle $\alpha$ from a plane that bisects the board in a vertical direction, and wherein the angle $\alpha$ increases slightly between successive rows of compound slots from the rear edge to the front edge.

* * * * *